US010795313B2

(12) United States Patent
Sakai et al.

(10) Patent No.: US 10,795,313 B2
(45) Date of Patent: Oct. 6, 2020

(54) IMAGE FORMING DEVICE, IMAGE PRINTING METHOD, AND COMPUTER PROGRAM OF FOIL PRINTING

(71) Applicant: Konica Minolta Inc., Tokyo (JP)

(72) Inventors: Tetsuya Sakai, Toyokawa (JP); Yoshinori Tsutsumi, Toyokawa (JP); Kenji Tsuru, Toyokawa (JP); Munenori Nakano, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/556,433

(22) Filed: Aug. 30, 2019

(65) Prior Publication Data

US 2020/0073326 A1 Mar. 5, 2020

(30) Foreign Application Priority Data

Sep. 5, 2018 (JP) ..... 2018-165744

(51) Int. Cl.
*G03G 15/20* (2006.01)
*G03G 21/20* (2006.01)
*G03G 15/01* (2006.01)

(52) U.S. Cl.
CPC ..... *G03G 21/20* (2013.01); *G03G 15/0121* (2013.01)

(58) Field of Classification Search
CPC ..... G03G 21/20; G03G 15/0121
See application file for complete search history.

(56) References Cited

U.S. PATENT DOCUMENTS 6,605,174 B1 * 8/2003 Landa ..... B32B 27/08 156/233
2010/0212821 A1 * 8/2010 Grinberg ..... B41F 19/062 156/247
2011/0229819 A1 * 9/2011 Hiramoto ..... G03G 15/6582 430/124.13
2012/0028175 A1 * 2/2012 Uchino ..... G03G 9/08706 430/48
2012/0156609 A1 * 6/2012 Matsushima ..... G03G 15/1605 430/124.1
2012/0177417 A1 * 7/2012 Fujita ..... G03G 15/1625 399/297
2012/0251174 A1 * 10/2012 Shirai ..... G03G 15/0189 399/132
2012/0264045 A1 * 10/2012 Matsushima ..... G03G 15/1625 430/109.3

(Continued)

FOREIGN PATENT DOCUMENTS

JP 2016528064 A 9/2016

*Primary Examiner* — G.M. A Hyder
(74) *Attorney, Agent, or Firm* — Cantor Colburn LLP

(57) ABSTRACT

An image forming device that prints a first image using first toner and prints a second image using foil on a sheet of paper, includes: a former that forms a first toner image by the first toner of the first image on the paper and forms a second toner image by second toner different from the first toner of the second image on the paper; a fixer that fixes the first toner image and the second toner image formed on the paper; a melter that melts the second toner out of the first toner and the second toner fixed to the paper; and a foil printer that prints the second image by bonding the foil to the melted second toner.

9 Claims, 11 Drawing Sheets

(56) References Cited

U.S. PATENT DOCUMENTS

| | | | | |
|---|---|---|---|---|
| 2013/0279952 | A1* | 10/2013 | Suzuki | G03G 15/1665 399/297 |
| 2013/0287455 | A1* | 10/2013 | Suzuki | G03G 15/16 399/297 |
| 2013/0308992 | A1* | 11/2013 | Suzuki | G03G 15/16 399/341 |
| 2017/0257508 | A1* | 9/2017 | Kawasaki | G03G 15/50 |
| 2018/0093468 | A1* | 4/2018 | Sasami | G03G 15/6585 |
| 2018/0367706 | A1* | 12/2018 | Tsukano | H04N 1/6097 |

* cited by examiner

IMAGE FORMING DEVICE, IMAGE PRINTING METHOD, AND COMPUTER PROGRAM OF FOIL PRINTING

CROSS REFERENCE TO RELATED APPLICATION

The present application claims priority under 35 U.S.C. § 119 to Japanese patent Application No. 2018-165744, filed on Sep. 5, 2018, the entire content of which is incorporated herein by reference.

BACKGROUND

Technological Field

The present invention relates to a technology of an image forming device that prints using foil.

Description of the Related Art

Image forming devices with various functions such as copy, scan, fax, and box become popular. Such image forming device is sometimes referred to as "multi function peripherals (MFP)". Also, production printers for printing publications such as books, magazines, and newspapers also become popular as one of the image forming devices.

The image forming device may perform monochrome printing of printing an image in black and white or color printing of printing in color. Furthermore, there is one which may print using foil such as gold foil and silver foil. JP 2016-528064 A discloses an invention of a printing method of printing foil used in a printing device such as an image forming device.

The invention of the printing method disclosed in JP 2016-528064 A relates to a method or a system for personalizing a substrate or preparing a substrate before gold plating. Specifically, the present invention relates to a printing method including a gold plating step in which an area of the substrate to be gold plated is in contact with a gold foil sheet following a step at which the substrate is subjected to ink jet printing, and including an additional step executed before the gold plating step for preparing the substrate. In this printing method, by using printing ink or the like for the area coated with gold plating, the area is provided with adhesiveness. This makes it possible to use gold foil without an adhesive film.

Printing with the foil increases time required for printing as compared to a case of printing without the foil.

SUMMARY

An object of the present invention is, in view of such problems, to shorten the time required for printing using the foil as compared with that in the conventional art.

To achieve the abovementioned object, according to an aspect of the present invention, there is provided an image forming device that prints a first image using first toner and prints a second image using foil on a sheet of paper, and the image forming device reflecting one aspect of the present invention comprises: a former that forms a first toner image by the first toner of the first image on the paper and forms a second toner image by second toner different from the first toner of the second image on the paper; a fixer that fixes the first toner image and the second toner image formed on the paper; a melter that melts the second toner out of the first toner and the second toner fixed to the paper; and a foil printer that prints the second image by bonding the foil to the melted second toner.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
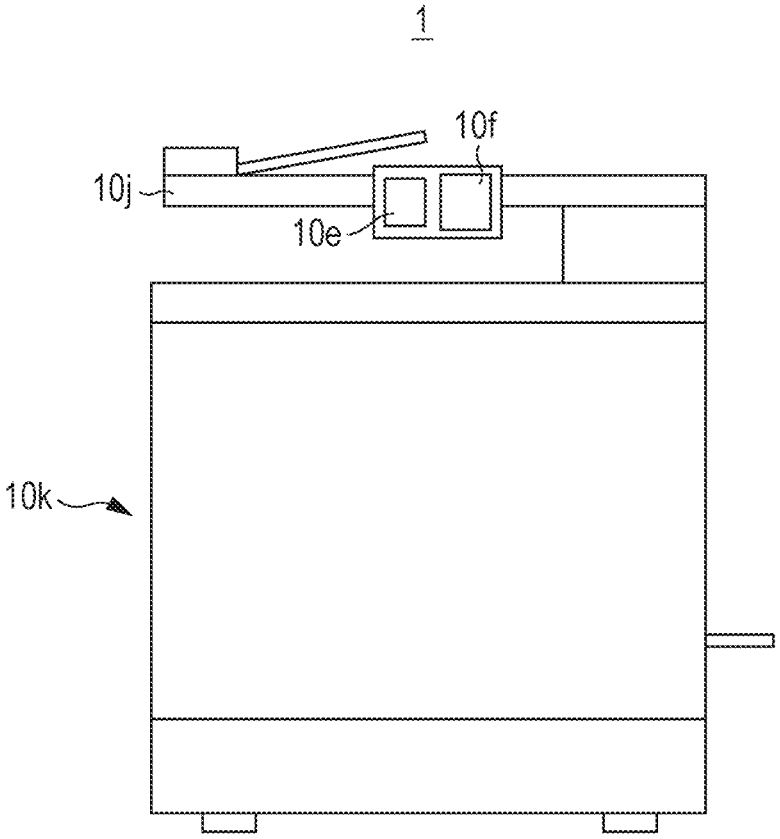
FIG. 1 is a view illustrating an example of an appearance of an image forming device.
Figure 2:
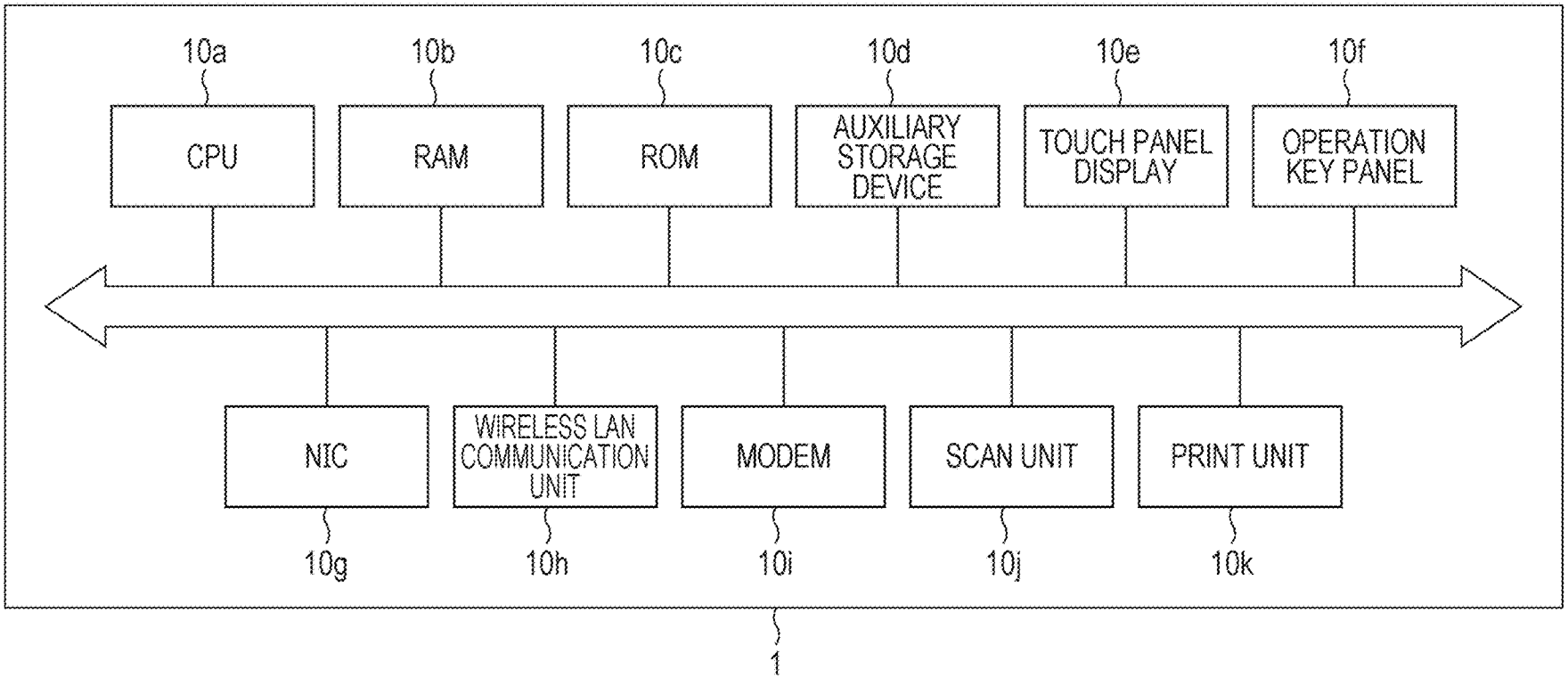
FIG. 2 is a view illustrating an example of a hardware configuration of the image forming device.
Figure 3:
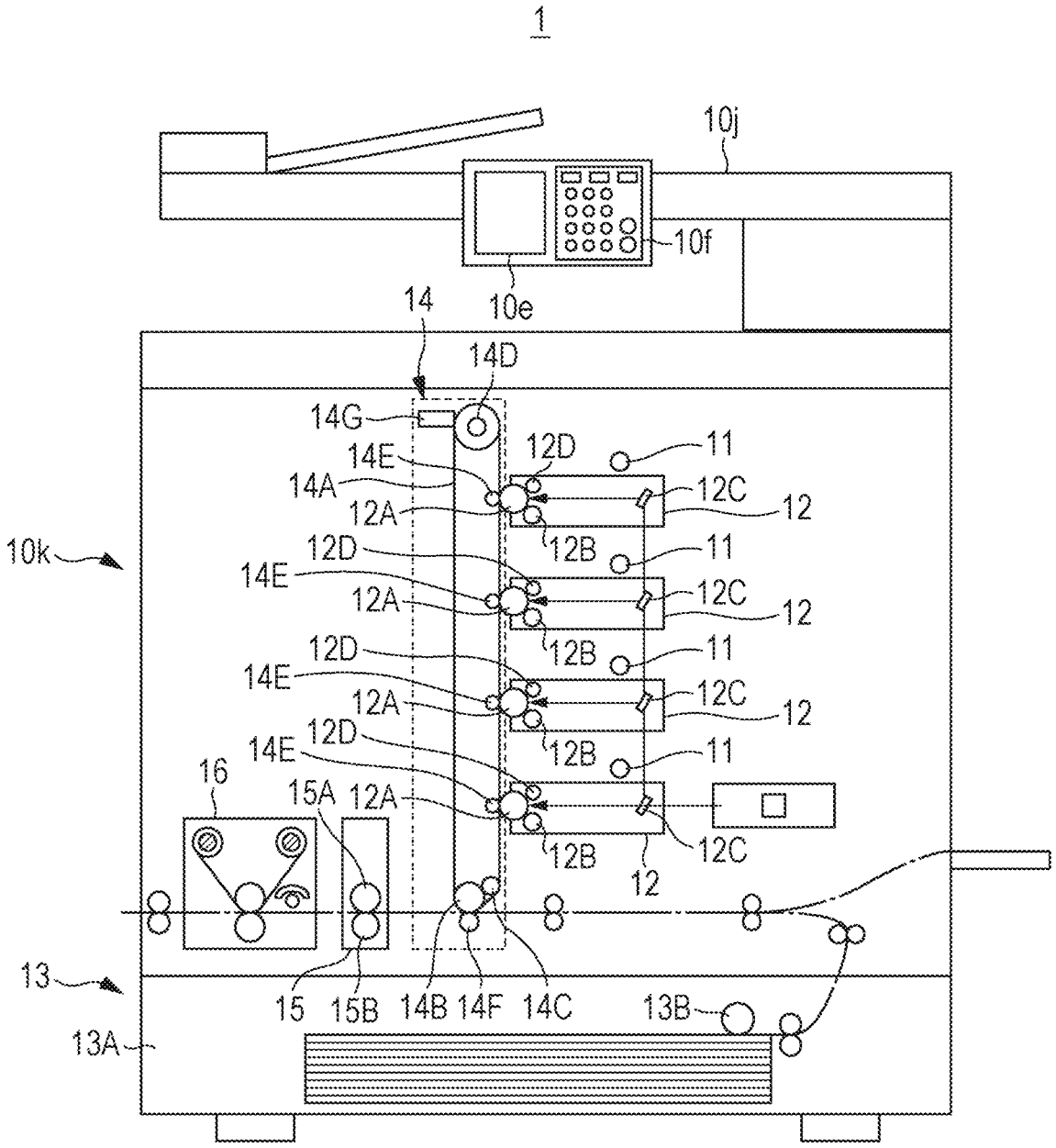
FIG. 3 is a view schematically illustrating an example of a configuration of a print unit.
Figure 4:
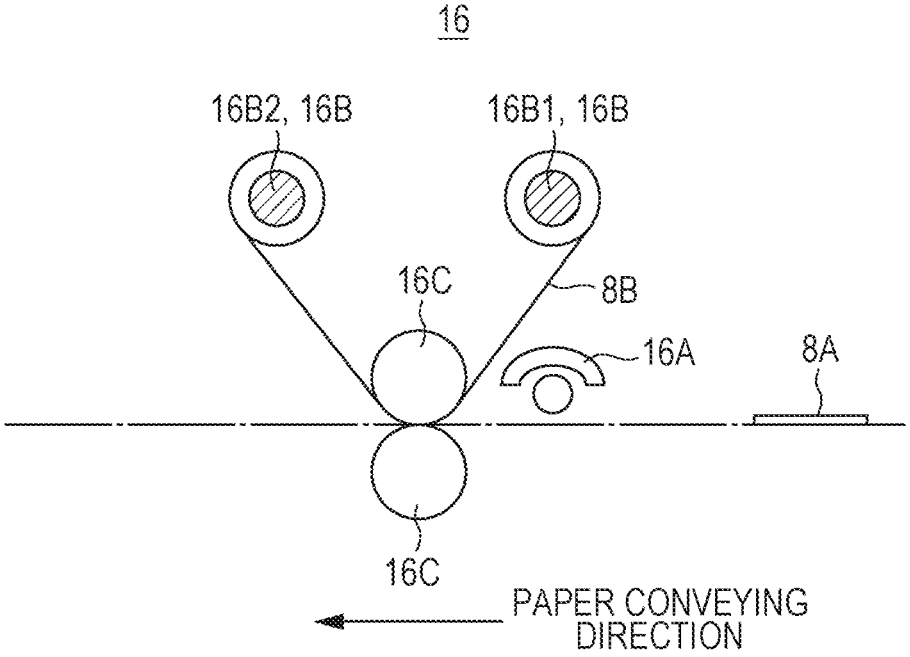
FIG. 4 is a view schematically illustrating an example of a configuration of a plating unit.
Figure 5:
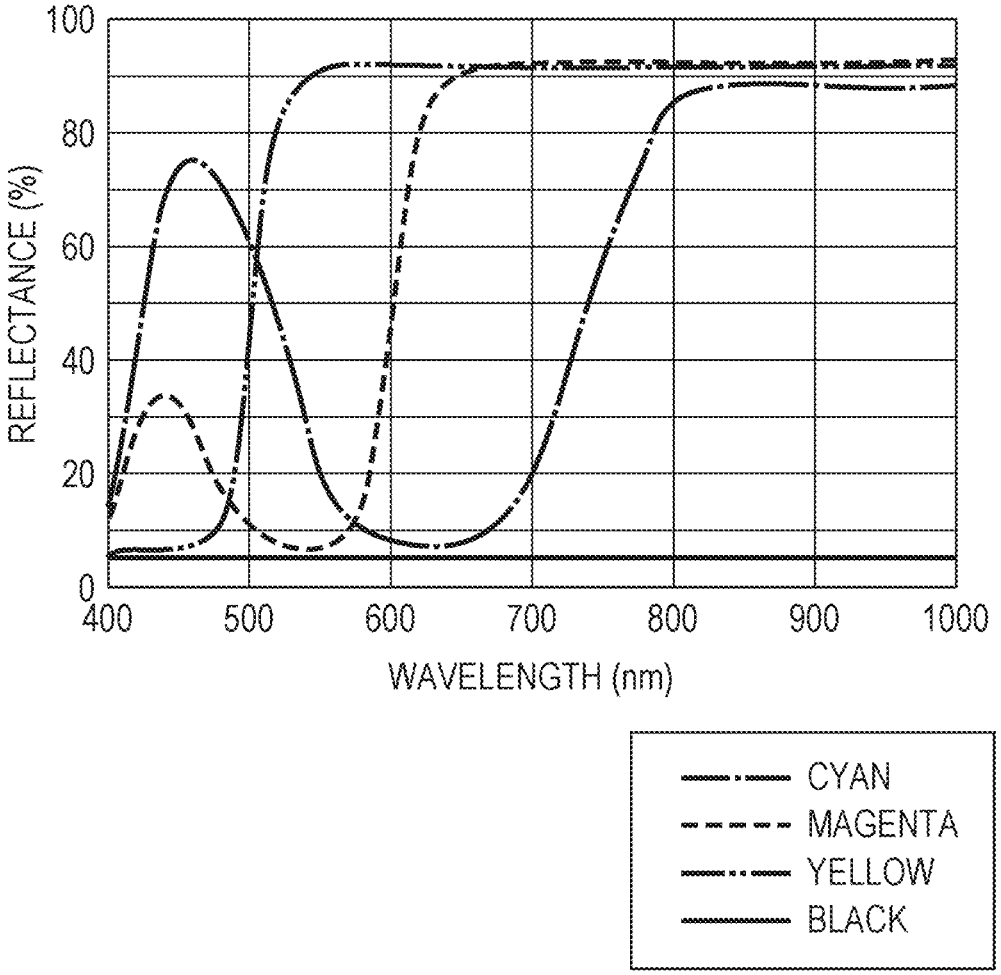
FIG. 5 is a view illustrating an example of a spectral reflectance characteristic of toner.
Figure 6:
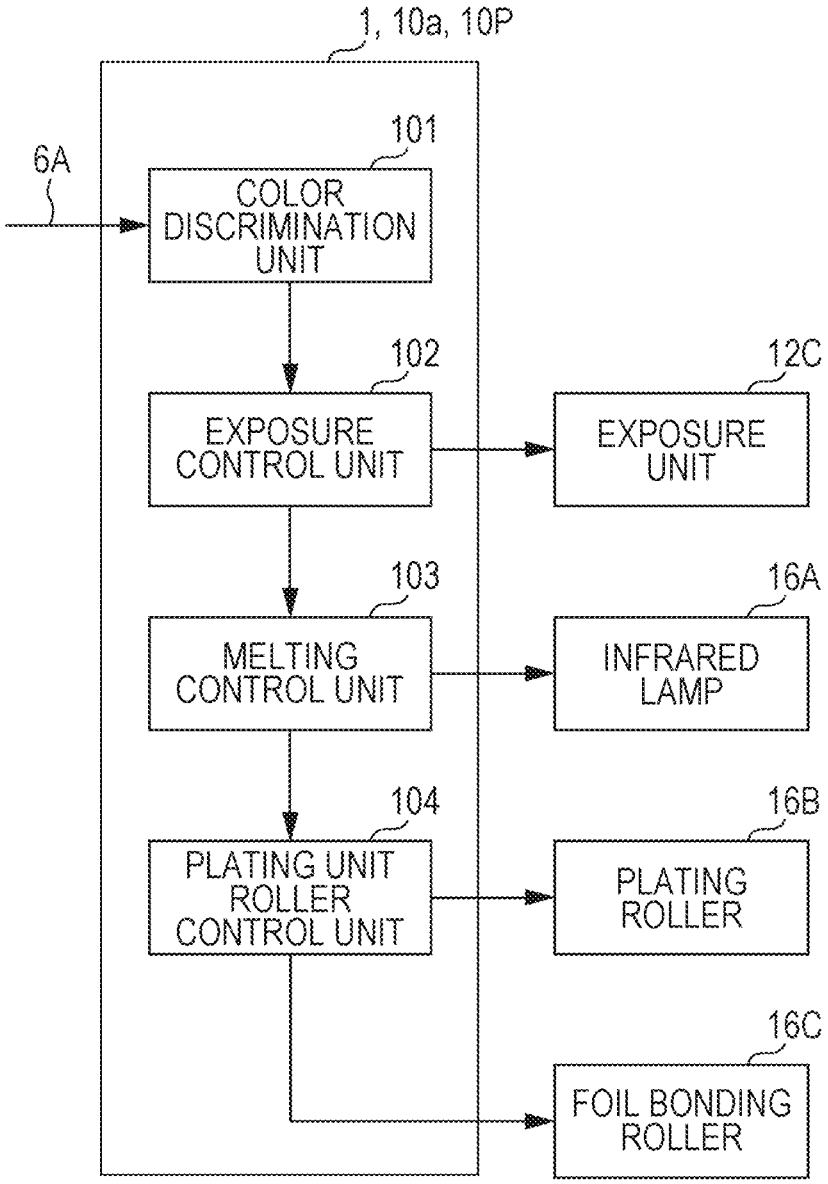
FIG. 6 is a view illustrating an example of a functional configuration of the image forming device.

FIG. 1 is a view illustrating an example of an appearance of an image forming device 1. FIG. 2 is a view illustrating an example of a hardware configuration of the image forming device 1. FIG. 3 is a view schematically illustrating an example of a configuration of a print unit 10*k*. FIG. 4 is a view schematically illustrating an example of a configuration of a plating unit 16. FIG. 5 is a view illustrating an example of a spectral reflectance characteristic of toner. FIG. 6 is a view illustrating an example of a functional configuration of the image forming device 1.

The image forming device 1 illustrated in FIG. 1 is a device in which functions of copy, PC print, fax, scanner, and box are integrated. In general, this is sometimes referred to as a "complex machine" or "multi function peripherals (MFP)".

The PC print function is a function of printing an image of data on paper on the basis of the data received from a terminal device such as a personal computer. This is sometimes referred to as "network printing" or "network print".

The box function is a function of storing to manage image data and the like by each user using a user's own storage area referred to as a "box", a "personal box" or the like provided to each user. It is possible to provide the box for each group and share the same by members of the group. The box corresponds to a "folder" or a "directory" in the personal computer.

As illustrated in FIG. 2, the image forming device 1 is formed by a central processing unit (CPU) 10*a*, a random access memory (RAM) 10*b*, a read only memory (ROM) 10*c*, an auxiliary storage device 10*d*, a touch panel display 10*e*, an operation key panel 10*f*, a network interface card (NIC) 10*g*, a wireless local area network (LAN) communication unit 10*h*, a modem 10*i*, a scan unit 10*j*, the print unit 10*k* and the like.

The CPU 10*a* is a main CPU of the image forming device 1. The RAM 10*b* is a main memory of the image forming device 1.

The touch panel display 10*e* displays a screen which displays a message for the user, a screen for the user to input a command or information, a screen which displays a result of processing executed by the CPU 10*a* and the like. Furthermore, a signal indicating a touched position is sent to the CPU 10*a*.

The operation key panel 10*f* is a so-called hardware keyboard, and is formed by ten keys, a start key, a stop key, a function key and the like.

The NIC 10*g* communicates with other devices using a protocol such as Transmission Control Protocol/Internet Protocol (TCP/IP).

The wireless LAN communication unit 10*h* communicates with other devices on the basis of the wireless LAN standard, that is, the Institute of Electrical and Electronics Engineers (IEEE) 802.11 standard.

The modem 10*i* exchanges document data with a fax terminal by the G3 protocol and the like.

The scan unit 10*j* reads an image on a document (sheet) set on an auto document feeder (ADF) or a platen glass to generate the image data.

The print unit 10*k* prints the image of the image data received from the terminal device or the like by the NIC 10*g*, the wireless LAN communication unit 10*h*, or the modem 10*i* in addition to the image read by the scan unit 10*j* on the paper.

The print unit 10*k* is a tandem or electrophotographic color printing engine. As illustrated in FIG. 3, this is formed by a toner bottle 11, an image forming unit 12, a paper feeding unit 13, a transfer unit 14, a fixing unit 15, the plating unit 16 and the like.

One toner bottle 11 and one image forming unit 12 are provided for each of cyan, magenta, yellow, and black (black). Hereinafter, the toner bottle 11 and image forming unit 12 of cyan are described as an example.

The toner bottle 11 stores cyan toner for replenishment. The image forming unit 12 is formed by a photosensitive drum 12A, a charging roller 12B, an exposure unit 12C, a developing roller 12D and the like.

The photosensitive drum 12A is a photosensitive drum for cyan. The charging roller 12B uniformly charges a surface of the photosensitive drum 12A to a negative polarity.

The exposure unit 12C forms an electrostatic latent image on the photosensitive drum 12A by exposing according to the image of the image data on the basis of a signal from the CPU 10*a*. The exposure unit 12C is formed by, for example, a semiconductor laser.

The developing roller 12D forms a toner image on the photosensitive drum 12A by supplying the cyan toner of the toner bottle 11 to the electrostatic latent image.

The toner bottle 11 and the image forming unit 12 of each of magenta, yellow, and black have roles similar to those of the toner bottle 11 and image forming unit 12 of cyan, respectively, and form a toner image of magenta, yellow, or black on the photosensitive drum 12A.

The paper feeding unit 13 is formed by one or more paper feeding cassettes 13A, one or more pickup rollers 13B and the like. The paper stored in the paper feeding cassette 13A is conveyed to the transfer unit 14 via a conveyance path indicated by a dashed dotted line in FIG. 3.

Meanwhile, the paper is conveyed in association with timing at which a secondary transfer roller 14F to be described later transfers (that is, secondarily transfers) the toner image transferred to an intermediate transfer belt 14A to be described later.

The transfer unit 14 is formed by the intermediate transfer belt 14A, a backup roller 14B, a driving roller 14C, a driven roller 14D, a primary transfer roller 14E, the secondary transfer roller 14F, a cleaning blade 14G and the like.

The intermediate transfer belt 14A is endless (that is, annular), and is wound around the backup roller 14B, the driving roller 14C, and the driven roller 14D. The intermediate transfer belt 14A rotates at a constant speed by rotation of the backup roller 14B and the driving roller 14C.

The primary transfer rollers 14E of cyan, magenta, yellow, and black are provided so as to face the photosensitive drums 12A of the respective colors. The primary transfer roller 14E transfers (that is, primarily transfers) the toner image on the photosensitive drum 12A to the intermediate transfer belt 14A by sandwiching the intermediate transfer belt 14A together with the photosensitive drum 12A.

The secondary transfer roller 14F secondarily transfers the toner image on the intermediate transfer belt 14A to the paper by sandwiching the paper conveyed from the paper feeding unit 13 and the intermediate transfer belt 14A together with the backup roller 14B.

The cleaning blade 14G removes toner remaining on the intermediate transfer belt 14A after the secondary transfer.

The fixing unit 15 is formed by a heating roller 15A, a pressurizing roller 15B and the like.

The heating roller 15A is heated at predetermined temperature to heat the paper to which the toner image is transferred. The pressurizing roller 15B forms a contact width (that is, a nip width) between the same and the heating roller 15A, and presses the paper passing through the nip width toward the heating roller 15A to fix the toner image to the paper. Hereinafter, the paper to which the toner image is fixed is referred to as an "intermediate printed matter 8A".

The plating unit 16 bonds foil such as gold foil or silver foil to the intermediate printed matter 8A. As illustrated in FIG. 4, the plating unit 16 is formed by an infrared lamp 16A, a plating roller 16B, a foil bonding roller 16C and the like.

The infrared lamp 16A radiates light to the intermediate printed matter 8A. The light radiated from the infrared lamp 16A is absorbed by the toner of the intermediate printed matter 8A and converted to heat energy. Then, the heat energy melts the toner of the intermediate printed matter 8A.

Herein, the light radiated from the infrared lamp 16A is light of 850 nm (nanometers) or longer, that is, infrared light, especially, near infrared light of a wavelength around 950 nm. By radiating the near infrared light to the intermediate printed matter 8A, it is possible to melt only the black toner out of the toner of the intermediate printed matter 8A. A reason that only the black toner melts is as follows.

As illustrated in FIG. 5, cyan toner (dashed-dotted line), magenta toner (dotted line), and yellow toner (dashed-two dotted line) have a reflectance to the near infrared light of almost 100%. However, the black toner (solid line) has the reflectance to the near infrared light of less than 10%. That is, the black toner absorbs most of the near infrared light. Therefore, when the near infrared light is radiated to the intermediate printed matter 8A, only the black toner absorbs the near infrared light and melts.

The plating roller 16B is formed by a film roller 16B1 and a winding roller 16B2. A foil film 8B obtained by stacking foil on a releasing liner such as a film is wound around the film roller 16B1. The winding roller 16B2 winds the foil film 8B from the film roller 16B1 in accordance with a speed at which the intermediate printed matter 8A is conveyed.

The foil bonding roller 16C is formed by a pair of rollers. The foil is bonded to the black toner by sandwiching the foil film 8B and the intermediate printed matter 8A in a state in which the black toner melts.

The ROM 10*c* or the auxiliary storage device 10*d* stores an application for realizing the above-described copy function and the like. Also, a plating program 10P is stored as one of programs related to printing.

The plating program 10P is a program for printing an image including a foil part to be printed using foil (hereinafter, referred to as an "image with foil 7A") on the paper. According to the plating program 10P, units from a color discrimination unit 101 to a plating unit roller control unit 104 in FIG. 6 are realized in the image forming device 1. The program is to be described later in detail.

Figure 7:
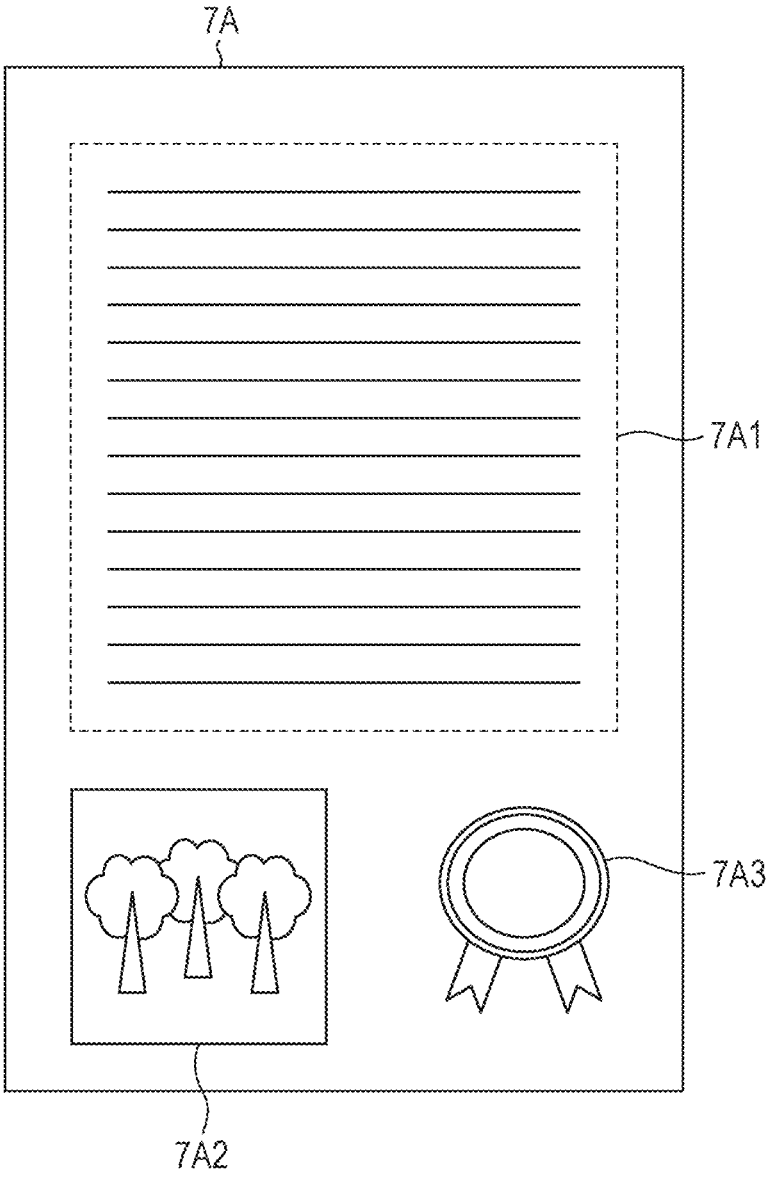
FIG. 7 is a view illustrating an example of an image with foil.

FIG. 7 is a view illustrating an example of the image with foil 7A. Hereinafter, operations of the units from the color discrimination unit 101 to the plating unit roller control unit 104 in FIG. 6 are described with reference to FIG. 7 taking a case where the image forming device 1 prints the image with foil 7A on the paper as an example.

In this embodiment, the image forming device 1 prints the image with foil 7A as illustrated in FIG. 7, for example. In the image with foil 7A, characters in a character area 7A1 are in black, a photograph 7A2 is a color photograph, and a pattern 7A3 is gold foil.

The user prepares an image file 6A of the image with foil 7A. For example, this is prepared by creating a document and the like with an application of the terminal device. Alternatively, this may also be prepared by downloading the image file 6A from a server on the Internet to the terminal device using a web browser, or by storing the image file 6A in advance in the auxiliary storage device of the terminal device and opening the file by the application.

The user gives the image forming device 1 a PC print job for the image of the prepared image file 6A (that is, the image with foil 7A). Then, the following processing is performed.

On the basis of the image file 6A, the color discrimination unit 101 (refer to FIG. 6) of the image forming device 1 specifies colors of respective parts of the image with foil 7A, and specifies a part with the foil (that is, a foil part of the image with foil 7A).

In this embodiment, the color discrimination unit 101 specifies that the characters in the character area 7A1 are in black, specifies colors used in respective parts of the photograph 7A2, and discriminates that the pattern 7A3 is foil (gold foil) on the basis of the image file 6A.

The exposure control unit 102 controls the exposure unit 12C so that the electrostatic latent image is formed on the photosensitive drum 12A on the basis of a result specified by the color discrimination unit 101.

At that time, the exposure control unit 102 controls the exposure unit 12C as follows when the color discrimination unit 101 specifies the foil part of the image with foil 7A.

That is, the exposure control unit 102 controls the exposure unit 12C of black so that the electrostatic latent image of the foil part of the image with foil 7A is formed on the photosensitive drum 12A of black.

Also, the exposure control unit 102 controls the exposure units 12C of the colors of cyan, magenta, and yellow so that the electrostatic latent image of the black part of the image with foil 7A is formed on the photosensitive drums 12A of the respective colors. By doing so, the image forming device 1 may express the black part of the image with foil 7A without using the black toner.

Meanwhile, it is sufficient that the electrostatic latent image is formed on the photosensitive drum 12A in a conventional manner for parts other than black and foil in the image with foil 7A.

In this embodiment, the exposure control unit 102 controls the exposure unit 12C of black so that the electrostatic latent image of the part of the pattern 7A3 is formed on the photosensitive drum 12A of black.

Also, the exposure control unit 102 controls the exposure units 12C of the colors of cyan, magenta, and yellow so that the electrostatic latent image of the character part of the character area 7A1 is formed on the photosensitive drums 12A of the respective colors. Furthermore, the exposure units 12C of the colors of cyan, magenta, and yellow are controlled so that the electrostatic latent images corresponding to the colors used in the photograph 7A2 are formed on the photosensitive drums 12A of the respective colors.

The image forming unit 12 including the exposure unit 12C controlled as described above by the exposure control unit 102 and the transfer unit 14 form the toner images of the cyan toner, magenta toner, and yellow toner of the image of the part in which the foil is not used of the image with foil 7A on the paper. Also, the toner image by the black toner of the image of the part in which the foil is used in the image with foil 7A is formed on the paper.

By fixing the toner image formed on the paper by the fixing unit 15, the intermediate printed matter 8A of the image with foil 7A is completed.

When the color discrimination unit 101 specifies the foil part of the image with foil 7A, the melting control unit 103 controls the infrared lamp 16A to radiate the near infrared light to the intermediate printed matter 8A of the image with foil 7A. As a result, the black toner of the intermediate printed matter 8A of the image with foil 7A melts.

The plating unit roller control unit 104 controls the plating roller 16B and the foil bonding roller 16C so that the foil is bonded to the black toner of the intermediate printed matter 8A of the image with foil 7A when the color discrimination unit 101 discriminates the foil part.

Thereafter, the printed matter on which the image is printed is discharged from the image forming device 1. In this embodiment, the printed matter on which the image with foil 7A is printed is discharged.

Figure 8:
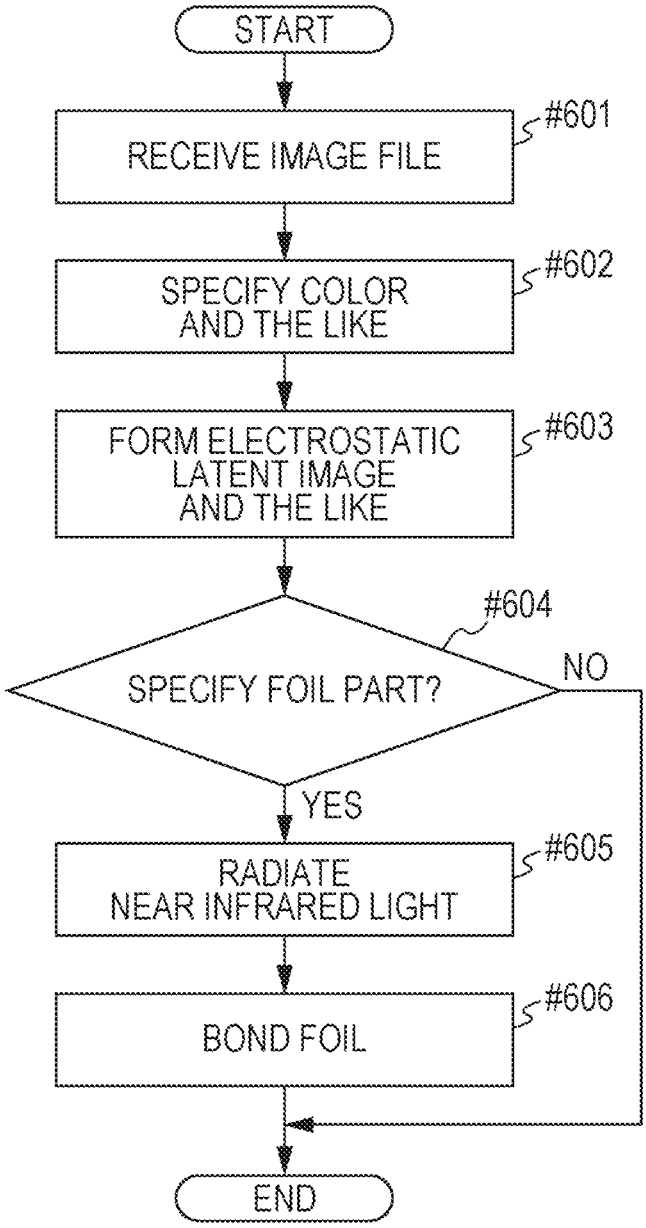
FIG. 8 is a flowchart illustrating an example of an overall processing flow of the image forming device.

FIG. 8 is a flowchart illustrating an example of an overall processing flow of the image forming device 1. Next, the overall processing flow of the image forming device 1 is described with reference to the flowchart in FIG. 8.

The image forming device 1 executes the processing by a procedure illustrated in FIG. 8 on the basis of the plating program 10P.

The image forming device 1 receives the image file 6A from the terminal device (#601 in FIG. 8), specifies the colors of the respective parts of the image illustrated in the image file 6A, and specifies the foil part of the image (#602). On the basis of a specified result, the electrostatic latent images are formed on the photosensitive drums 12A of cyan, magenta, yellow, and black, and the toner images are formed on the paper (#603).

Specifically, in a case where the foil part may be specified, the image forming device 1 forms the electrostatic latent image of the foil part on the photosensitive drum 12A of black. Then, the electrostatic latent images of the part including black other than the foil part are formed on the photosensitive drums 12A of cyan, magenta, and yellow, respectively. Alternatively, in a case where the foil part cannot be specified, the electrostatic latent images are formed on the photosensitive drums 12A of cyan, magenta, yellow, and black according to the color of the image and the part of the color in the image as in the conventional manner.

The image forming device 1 forms the toner image on the paper on the basis of the electrostatic latent image formed on the photosensitive drum 12A. Then, the toner image is fixed to the paper, so that the intermediate printed matter 8A is generated.

In a case where the image forming device 1 may specify the foil part (Yes at #604), this radiates the near infrared light to the intermediate printed matter 8A (#605) to bond the foil to the intermediate printed matter 8A (#606).

The image forming device 1 performs processes at steps #601 to #606 described above each time the image file 6A is received from the terminal device.

According to this embodiment, time required for printing using the foil may be made shorter than before.

<Variation>

Figure 9:
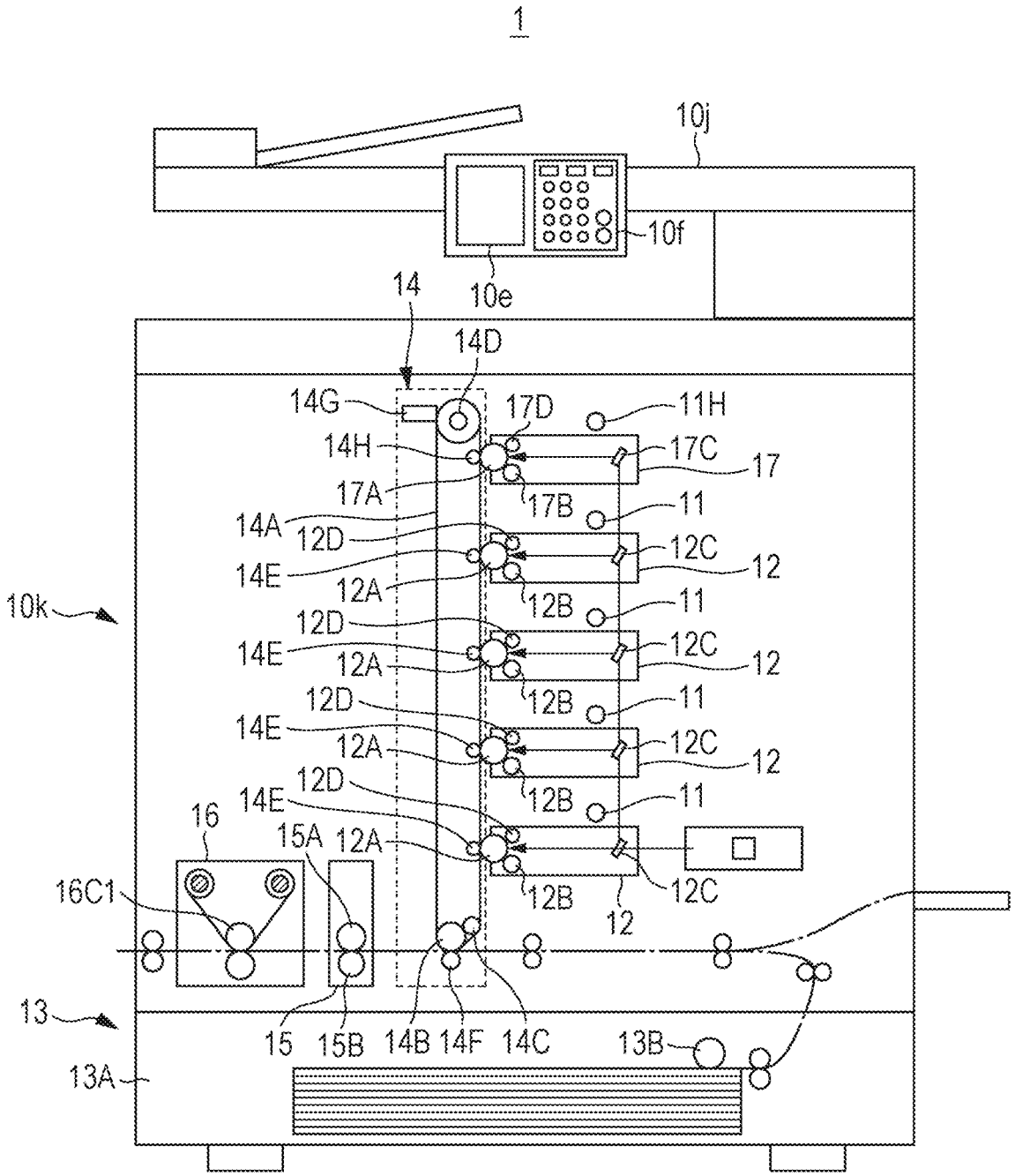
FIG. 9 is a view schematically illustrating another example of the configuration of the print unit.
Figure 10:
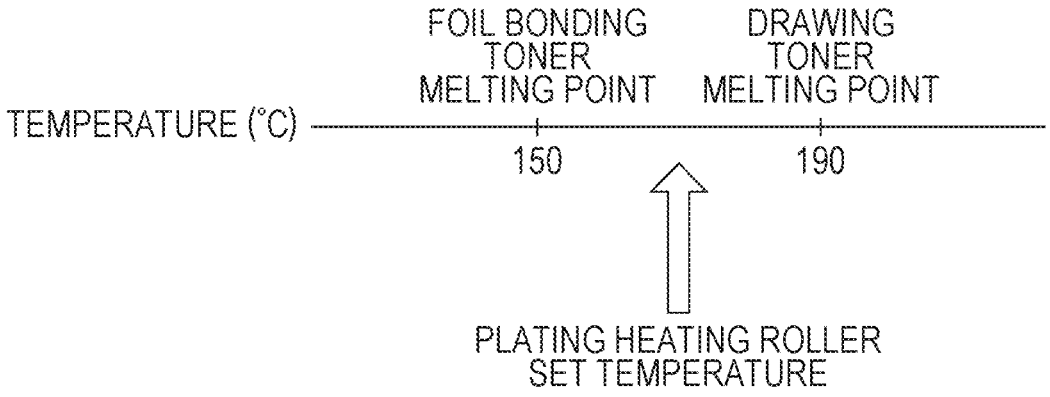
FIG. 10 is a view illustrating an example of temperature of a plating heating roller, a melting point of foil bonding toner, and a melting point of drawing toner.
Figure 11:
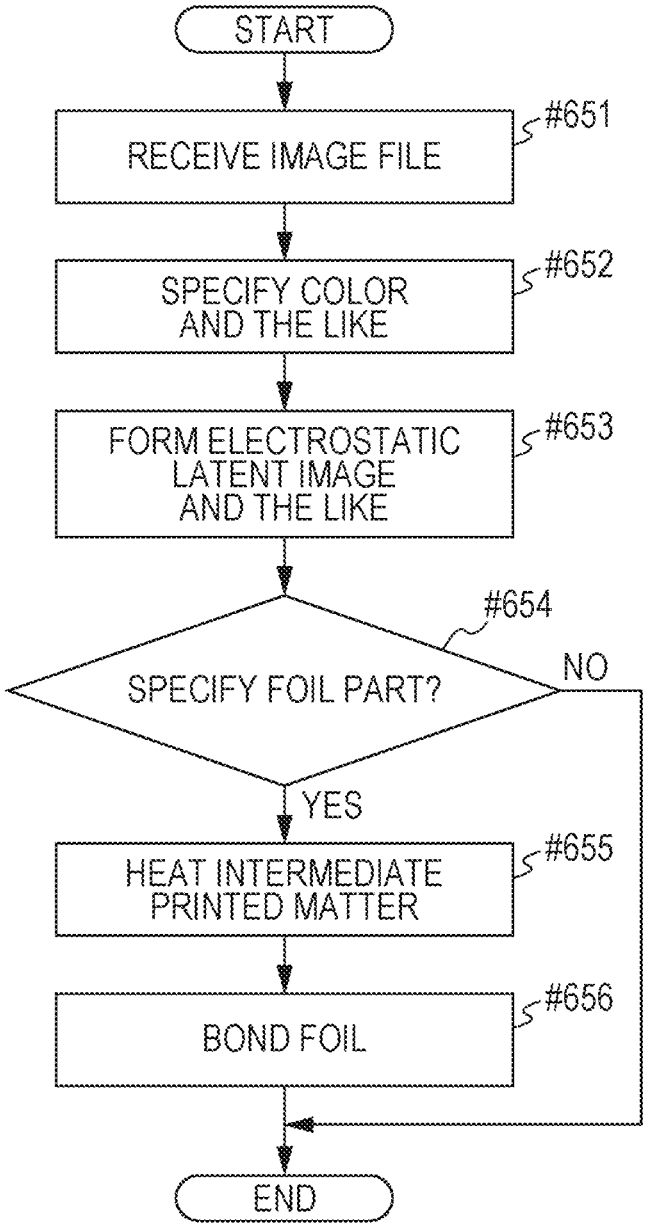
FIG. 11 is a flowchart illustrating another example of an overall processing flow of the image forming device.

FIG. 9 is a view schematically illustrating another example of the configuration of the print unit 10*k*. FIG. 10 is a view illustrating an example of temperature of the plating heating roller 16C1, a melting point of foil bonding toner, and a melting point of drawing toner. FIG. 11 is a flowchart illustrating another example of the overall processing flow of the image forming device 1.

In the above-described embodiment, the foil is bonded using the black toner, and black (black) is expressed using the cyan toner, magenta toner, and yellow toner. However, when expressing black in this manner, it is not possible to express black as clearly as when using the black toner.

Therefore, toner for bonding the foil (hereinafter, referred to as "foil boning toner") may also be separately prepared. Then, the black toner may be used to express black.

In this case, as illustrated in FIG. 9, the print unit 10*k* is further provided with a toner bottle 11H of the foil bonding toner.

The foil bonding toner has a melting point lower than that of the cyan toner, magenta toner, yellow toner, and black toner (hereinafter, referred to as "drawing toner"). For example, the melting point of the drawing toner is about 190 degrees, but the melting point of the foil bonding toner is about 150 degrees. Meanwhile, the foil bonding toner is desirably transparent, white, or in a color close to white.

Also, the print unit 10*k* is further provided with an image forming unit 17. The image forming unit 17 is provided with a photosensitive drum 17A, a charging roller 17B, an exposure unit 17C, and a developing roller 17D for the foil bonding toner. Units from the photosensitive drum 17A to the developing roller 17D operate in a manner similar to that of the units from the photosensitive drum 12A to the developing roller 12D described above.

Also, the transfer unit 14 is further provided with a primary transfer roller 14H. The primary transfer roller 14H is provided so as to face the photosensitive drum 17A. The primary transfer roller 14H operates in a manner similar to that of the primary transfer roller 14E described above.

The plating unit 16 is not provided with the above-described infrared lamp 16A. However, one roller of the foil bonding rollers 16C of the plating unit 16 heats the intermediate printed matter 8A (and the foil film 8B). Hereinafter, this roller is referred to as the "plating heating roller 16C1".

Herein, as illustrated in FIG. 10, the plating heating roller 16C1 heats the intermediate printed matter 8A at temperature not lower than the melting point of the foil bonding toner and lower than the melting point of the drawing toner. By doing so, it is possible to melt only the foil bonding toner out of the toner of the intermediate printed matter 8A.

The plating heating roller 16C1 also sandwiches the foil film 8B and the intermediate printed matter 8A in a state in which the foil bonding toner melts between the same and the other roller of the foil bonding rollers 16C. By doing so, the foil is bonded to the foil bonding toner.

Meanwhile, if the intermediate printed matter 8A conveyed from the fixing unit 15 is not sufficiently cooled, temperature of the intermediate printed matter 8A might be higher than the melting point of the drawing toner by heating by the plating heating roller 16C1. Therefore, a sufficient distance may be provided between the fixing unit 15 and the plating unit 16 so that the intermediate printed matter 8A is cooled. Alternatively, a device for cooling the intermediate printed matter 8A may be installed between the fixing unit 15 and the plating unit 16.

Also, in a case of preparing the foil bonding toner and using the black toner to express black (black), the units from the color discrimination unit 101 to the plating unit roller control unit 104 of the image forming device 1 (refer to FIG. 6) perform operations as follows.

That is, the color discrimination unit 101 of the image forming device 1 specifies colors of respective parts of the image with foil 7A, and specifies a foil part of the image with foil 7A as in the above-described manner.

When the color discrimination unit 101 specifies the foil part of the image with foil 7A, the exposure control unit 102 controls the exposure unit 17C so that the electrostatic latent image of the foil part of the image with foil 7A is formed on the photosensitive drum 17A. Meanwhile, it is sufficient that the electrostatic latent image is formed on the photosensitive drum 12A as in a conventional manner for parts other than the foil in the image with foil 7A.

The melting control unit 103 heats the plating heating roller 16C1 so that the temperature of the plating heating roller 16C1 is equal to or higher than the melting point of the foil bonding toner and lower than the melting point of the drawing toner. Meanwhile, the plating heating roller 16C1 may be always heated, or may be heated only when the color discrimination unit 101 discriminates the foil part.

The plating unit roller control unit 104 controls the plating roller 16B and the foil bonding roller 16C so that the foil is bonded to the foil bonding toner of the intermediate printed matter 8A of the image with foil 7A when the color discrimination unit 101 discriminates the foil part.

Also, in a case of preparing the foil bonding toner and using the black toner to express black (black), the image forming device 1 executes processing by a procedure illustrated in FIG. 11 on the basis of the plating program 10P.

The image forming device 1 performs processes similar to those at steps #601 and #602 described above (#651 and 652 in FIG. 11).

In a case where the foil part may be specified, the image forming device 1 forms the electrostatic latent image of the foil part on the photosensitive drum 17A, forms the electrostatic latent images of the part other than the foil part on the photosensitive drums 12A of cyan, magenta, yellow, and black, and forms the toner images on the paper (#653). Alternatively, in a case where the foil part cannot be specified, the electrostatic latent images are formed as in the conventional manner and the toner images are formed on the paper as described above.

After the intermediate printed matter 8A is generated on the basis of the electrostatic latent image, the image forming device 1 heats the intermediate printed matter 8A again (#655) and bonds the foil to the intermediate printed matter 8A (#656) in a case where the foil part may be specified (Yes at #654).

By the above-described processing, the foil is bonded by the foil bonding toner, black (black) is expressed by the black toner, and the image with foil 7A is printed on the paper.

In the above-described embodiment, the image forming device 1 prints the image with foil 7A on the basis of the image file 6A received from the terminal device. However, printing may also be performed on the basis of the image file 6A prepared by the user by the image forming device 1.

In the above-described embodiment, in addition to plain paper, label paper obtained by stacking two sheets via an adhesive layer may be used.

In the above-described embodiment, the fixing unit 15 may be further controlled by the plating program 10P. In this case, after the toner image is formed on the paper at step #603 or #653, the fixing unit 15 is controlled before radiating the near infrared light at step #605 or heating the paper again at step #655. Specifically, the fixing unit 15 is controlled to heat or pressurize the paper at timing at which the paper is fed from the transfer unit 14 to the fixing unit 15.

In addition, the configuration of the entire or a part of the image forming device 1, contents and order of the processes, the data configuration and the like may be appropriately changed in accordance with the spirit of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming device that prints a first image using first toner and prints a second image using foil on a sheet of paper, the image forming device comprising:

a former that forms a first toner image by the first toner of the first image on the paper and forms a second toner image by second toner different from the first toner of the second image on the paper;

a fixer that fixes the first toner image and the second toner image formed on the paper;

a melter that selectively melts the second toner out of the first toner and the second toner fixed to the paper while not melting the first toner; and a foil printer that prints the second image by bonding the foil to the melted second toner.

2. The image forming device according to claim 1, wherein the melter irradiates the paper to which the first toner image and the second toner image are fixed with light which is more easily absorbed by the second toner than the first toner to melt the second toner fixed to the paper.

3. The image forming device according to claim 2, wherein the first toner is cyan toner, magenta toner, and yellow toner, the second toner is black toner, and the light is near infrared light.

4. The image forming device according to claim 3, wherein the former forms the first toner image of a black part of the first image on the paper using the cyan toner, magenta toner, and yellow toner of the first toner.

5. The image forming device according to claim 1, wherein the first toner is cyan toner, magenta toner, yellow toner, and black toner, the second toner is toner having a melting point lower than the melting point of the first toner, the melter melts the second toner by heating the paper to which the first toner image and the second toner image are fixed at temperature at which the first toner is not melted and the second toner is melted.

6. The image forming device according to claim 5, wherein a color of the second toner is white or transparent.

7. The image forming device according to claim 5, comprising:

a cooler that cools the paper to which the first toner image and the second toner image are fixed between the fixer and the melter.

8. An image printing method that prints a first image using first toner and prints a second image using foil on a sheet of paper, the image forming method comprising:

forming a first toner image by the first toner of the first image on the paper and forming a second toner image by second toner different from the first toner of the second image on the paper;

fixing the first toner image and the second toner image formed on the paper;

selectively melting the second toner out of the first toner and the second toner fixed to the paper while not melting the first toner; and printing the second image by bonding the foil to the melted second toner.

9. A non-transitory recording medium storing a computer readable program for controlling an image forming device that prints a first image using first toner and prints a second image using foil on a sheet of paper, the computer readable program for causing the image forming device to execute:

forming a first toner image by the first toner of the first image on the paper and forming a second toner image by second toner different from the first toner of the second image on the paper;

selectively melting the second toner out of the first toner and the second toner fixed to the paper while not melting the first toner; and printing the second image by bonding the foil to the melted second toner.

* * * * *